United States Patent [19]

Matsumoto et al.

[11] Patent Number: 4,599,294

[45] Date of Patent: Jul. 8, 1986

[54] PARTICLES OBTAINED BY ATOMIZATION WHILE APPLYING VOLTAGE

[75] Inventors: Tohru Matsumoto, Kita; Masuo Yamazaki, Yokohama, both of Japan

[73] Assignee: Canon Kabushiki Kaisha, Tokyo, Japan

[21] Appl. No.: 738,520

[22] Filed: May 29, 1985

Related U.S. Application Data

[63] Continuation of Ser. No. 481,743, Apr. 4, 1983, abandoned.

[30] Foreign Application Priority Data

| | | | |
|---|---|---|---|
| Apr. 6, 1982 | [JP] | Japan | 57-56959 |
| Apr. 6, 1982 | [JP] | Japan | 57-56960 |
| Apr. 6, 1982 | [JP] | Japan | 57-56958 |
| Jun. 10, 1982 | [JP] | Japan | 57-100355 |
| Jun. 10, 1982 | [JP] | Japan | 57-100357 |
| Jun. 10, 1982 | [JP] | Japan | 57-100361 |

[51] Int. Cl.[4] ..... G03G 9/08

[52] U.S. Cl. ..... 430/137; 430/138; 264/8; 264/10

[58] Field of Search ..... 430/109, 111, 137, 138; 264/8, 10

[56] References Cited

U.S. PATENT DOCUMENTS

| | | | |
|---|---|---|---|
| 3,674,736 | 7/1972 | Lerman et al. | 430/137 X |
| 3,830,750 | 8/1974 | Wellman | 430/137 |
| 4,162,282 | 7/1979 | Fulwyler et al. | 264/10 X |
| 4,288,519 | 9/1981 | Diamond et al. | 430/137 |

FOREIGN PATENT DOCUMENTS

| | | | |
|---|---|---|---|
| 1622354 | 3/1971 | Fed. Rep. of Germany | 430/137 |
| 2508095 | 8/1975 | Fed. Rep. of Germany | 430/137 |
| 57-189145 | 11/1982 | Japan | 430/137 |
| 550022 | 6/1974 | Switzerland | 264/10 |

*Primary Examiner*—Roland E. Martin

*Attorney, Agent, or Firm*—Fitzpatrick, Cella, Harper & Scinto

[57] ABSTRACT

When a particulate material under molten or dissolved state is atomized by means of a fluid nozzle or a rotary disc type atomizer, a high voltage is applied to obtain particles which are uniform in shape and, for example, spherical with a narrow particle size distribution. Further, if necessary, the particles obtained are subsequently encapsulated in the continuous step.

6 Claims, 2 Drawing Figures

PARTICLES OBTAINED BY ATOMIZATION WHILE APPLYING VOLTAGE

This application is a continuation of application Ser. No. 481,743 filed Apr. 4, 1983, now abandoned.

BACKGROUND OF THE INVENTION

1. Field of the Invention

This invention relates to a toner and a microcapsule toner to be used for electrophotography, electrostatic printing, magnetic recording, and the like.

2. Description of the Prior Art

Toners to be used in electrophotography, electrostatic printing, magnetic recording, etc. are materials for formation and recording of images. For example, in electrophotography, there have been known a number of methods as disclosed in U.S. Pat. No. 2,297,691. Generally speaking, a photoconductive material is utilized, an electrical latent image is formed on a photosensitive body by various means, subsequently said latent image is developed by use of a toner, and the developed image, optionally after transferred onto a transfer member such as a paper, fixed by heating under pressurization or a solvent steam to obtain a copied product. Various methods have been proposed for development or fixation of toners and employed as desired.

As the toner to be used in the prior art for this purpose, there have been employed fine powders having coloring materials such as dyes or pigments dispersed in binding materials such as natural or synthetic resins. In general, fine particles have been prepared by blending binding materials with coloring materials, melt mixing the blend at a high temperature, and after cooling crushing the mixture by means of a crushing device utilizing a jet air stream. The toner to be used for the above purpose is intended in the first place to give uniform and stable images. However, the toner obtained according to the above method known in the art can hardly be obtained as essentially uniform particles since the toner is prepared through the mixing operation, the cooling operation and the crushing operation. That is, toners are generally employed with particle sizes of several microns to 30 microns, but it is very difficult to mix completely uniformly coloring materials and binding materials, whereby only ununiform particles can be obtained. For this reason, there have been employed a mixing device having a high shearing force and the method in which coloring materials are processed for improvement of dispersion in binding materials, but these methods proved to be not necessarily satisfactory. One reason is that, although a finely dispersed state may be maintained under heat molten state, phase separation occurs on cooling and therefore the particles as the result of crushing become ununiform. Further, when cooled under a considerably uniform state and subjected to crushing in the subsequent crushing step, even if the crushing force may be exerted uniformly, crushing is liable to occur at the portion which is essentially ununiform, whereby the particles formed in the crushing step cannot be obtained to have uniform shapes and, of course, there are various sizes, with the dispersion states of coloring materials being also diversely different. When such toner particles are practically used, due to such ununiformities possessed by the particles, namely ununiformities in optical properties such as coloring power, hiding power, etc., electrical properties such as electrostatic charges, conductivity, etc. and thermal properties such as melting point, melting heat, etc., no uniform developing characteristic, transfer characteristic or fixing characteristic can be obtained to give inevitably images which are ununiform, unclear or unstable. Also, ununiform shapes possessed by such toners of the prior art include ununiformity in mechanical strength. This leads to the result in practical use of the toner that there occurs changes of the toner due to the change in shapes of the toner, namely insufficient durability characteristic of the toner. In the prior art, for overcoming such problems, it has also been known to add or mix a substance for making uniform the entire mass and also to apply a surface treatment to make uniform the shapes or the characteristics of the particles or a classification treatment to make uniform the particle sizes. However, according to any one of these methods, it has been difficult to obtain satisfactory results.

As a means to overcome these problems, there is also known a method in which microparticles of a mixture of a monomer and a coloring material are prepared and polymerization is carried out under such a state to give directly a toner, as disclosed in Japanese Patent Publication No. 14895/1976. However, the method to prevent some problems involved in this method, namely to prevent completely lowering the toner characteristics caused by incomplete polymers, stabilizers or emulsifiers remaining in the toner, is insufficient and therefore practical application of this method for preparation of the toner was not realizable.

Particularly as a toner for pressure fixing, so called function-separated toner, namely the microcapsule toner is effective, which satisfies both aspects of fixing and developing characteristics at the same time. On the other hand, as core materials for microcapsule toners already known in the art, soft materials are generally employed. As the method for preparation of microcapsule particles with uniform particle sizes by use of soft core materials which can difficultly be crushed by a dry system crushing machine, there have been known in the prior art the two methods as shown below:

(i) Wet system crushing method; and (ii) Atomizing drying methed.

A wet system crushing method is a method in which formation of core particles is previously performed and subsequently or at the same time shells are formed to effect microencapsulation. Namely, the method comprises applying a dispersing step or emulsifying step (hereinafter called as the first step) to divide previously a core material into relatively smaller particles and an encapsulating step to attach shells thereon (called as the second step). The first step is a step wherein a large amount of an emulsifier is employed, further with addition of a dispersing aid, if required, and uniform microparticles are formed by utilizing a high speed stirrer or an ultrasonic crushing machine. The second step is a step, wherein a shell material is deposited and attached on the surfaces of the core particles after once separating said particles by filtration or continuously. As the method for deposition and attachment on the core particle surfaces, there may be utilized the interfacial polymerization method, the phase separation method or the temperature gradient precipitation method. In some cases, it is also possible to further form an intermediate layer, thereby reinforcing chemically or physical the shell material or the core material. However, according to this method, a large quantity of an emulsifier acting on micropulverization in the first step will necessarily remain on the core material surfaces in the second step subsequently conducted to lower to a great extent the adhesive force of the shell material with by-production of a large number of individual particles formed only of the shell material. As the result, it is difficult to obtain microcapsules with desired uniform particle sizes, which are good in so called mono-separability. Moreover, hygroscopic phenomenon may also occur due to the remaining emulsifier to give deleterious effects on electrophotographic characteristics. For this reason, there is generally performed a pre-treatment prior to the microencapsulation step to remove the emulsifier by washing the micropulverized core material with water or by utilizing an electric dialysis, a semipermeable memberance or an ion exchange resin. However, the microencapsulated particles produced by use of this method will result in decreased yield or increased cost due to cumbersomeness in working operations, thus involving very difficult problems in practice thereof. For producing microcapsule toners according to the wet crushing method, in addition to the above drawbacks, there is also a problem with respect to broadening of particle sizes caused necessarily by mechanical stirring.

On the other hand, the method of producing microcapsule particles by utilization of the atomizing drying method is a method in which a substance for core material and a substance for shell material, which are previously kneaded with each other or dispersed in a medium, are discharged through a nozzle under an atmospheric condition to have the shell material attached on the core particle surfaces. However, the microcapsule particles obtained by this method have generally a wide particle size distribution and the particles are liable to become coarse.

The microcapsule particles are polymeric vessels having sizes of about several microns to some hundred microns and, through utilization of the function to protect the content or to control release of the content, have been presently applied in various uses, not only in the aforesaid toner, but also in commercial products such as carbonless copying papers, rapid- or slow-acting pharmaceuticals, catalysts or rust preventives. In view of their wide utility values, the abovementioned usages are only a part of their applications, and a great development is expected for such microcapsule particles.

SUMMARY OF THE INVENTION

An object of the present invention is to provide a toner which has overcome the drawbacks as described above, that is, to provide toner particles, in which a coloring material and a binding material are uniformly dispersed, and which have uniform shapes and uniform particle sizes.

Another object of the present invention is to provide a uniformly shaped and completely spherical particulate toner.

Still another object of the present invention is to provide particles which are particularly electrostatically uniform.

Still another of the present invention is to provide a method for obtaining an inexpensive toner by a small number of steps.

Still another object of the present invention is to provide a toner which can give stable and uniform images.

Further, another object of the present invention is to provide a novel method for producing a toner.

Also, still antoher object of the present invention is to provide a microcapsule toner produced by the method having overcome the drawbacks as described above.

Further, still another object of the present invention is to provide a toner which can be utilized as a toner for electrophotography as such without classification or only with a slight classification operation, because the microcapsule toner obtained by this invention has an electrophotographically effective particle size of about 10 μm, and is also narrow in particle size distribution.

Still another object of the present invention is to provide a microcapsule toner containing substantially or entirely no emulsifier which inhibits attachment formation of a shell material.

Further object of the present invention is to provide a microcapsule toner which can prevent flying-up of material by application of a voltage during atomization of a core material and is high in yield.

The present invention having accomplished the above objects is a toner comprising a toner material containing a coloring material and a binding material, which are mixed under molten state or dissolved state to have the coloring material microdispersed in the binding material, the resultant dispersion being thereafter micropulverized under molten or dissolved state while applying an electrostatic force and after cooling and/or drying the micropulverized particles being collected.

Further, according to another embodiment of the present invention, the micropulverized particles while applying the said electrostatic force are collected in a liquid.

Further, according to another embodiment of the present invention, a liquid product containing a polymerizable monomer and a coloring material is previously prepared and thereafter micropulverization is effected while applying an electrostatic force, then the resultant particles are dispersed in a medium, followed by polymerization of the monomer, and the resultant particles are separated from the dispersion medium.

Further, another embodiment of the present invention is a microcapsule toner prepared by atomizing a component for the core material while applying a voltage, dispersing said atomized core material in a liquid containing a shell material to coat the core material with the shell material. In this embodiment, the shell material may further be polymerized, if desired.

Further, another embodiment of the present invention is a microcapsule particle produced by a process comprising the first step of forming a core material into particles while applying a voltage and the second step of performing shell formation, said first step and said second step being conducted substantially continuously.

DESCRIPTION OF THE PREFERRED EMBODIMENTS

Figure 1:
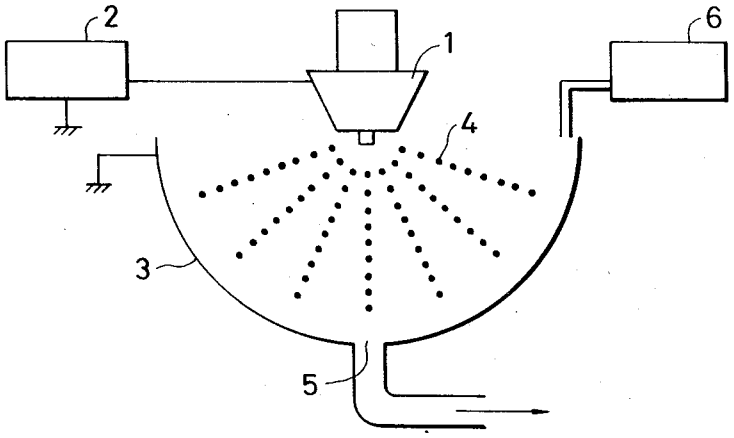
FIG. 1 is a schematic illustration of the exemplary steps for micropulverization of a liquid product.

One method to accomplish the present invention is to mix a coloring material and a binding material during heat melting thereof, thereby having the coloring material minutely dispersed in the binding material. For this purpose, there can be employed various mixing methods and devices known in the art. That is, roll mills, extruders, kneaders, mixers, etc. may be employed. The molten mixture is micropulverized under molten state by use of an electrostatic force. That is, simultaneously with supplying the dispersion under molten state by means of a mono-fluid nozzle or a gas-liquid mixed bi-fluid nozzle or a rotary disc type atomizer, an electrostatic force is applied from adjacent electrodes to effect micropulverization. The liquid droplets are solidified by cooling to give microparticles.

Another method to accomplish the present invention is to dissolve a binding material in a solvent and mixing a coloring material with the resultant solution by means of a mixer, etc. to prepare a minutely dispersed dispersion. Then, similarly as described above, an electrostatic force is applied to effect micropulverization and further drying the solvent by a heated air stream, etc. to give solid microparticles.

Still another method to accomplish the present invention is to melt by heating a binding material, further dissolve the molten product with addition of a solvent and mixing a coloring material with the resultant solution by means of a mixer, etc. to prepare a minutely dispersed dispersion. Then, similarly as described above, an electrostatic force is applied to effect micropulverization and further drying the solvent in a heated air stream, etc., followed by cooling, to give solid microparticles, namely toners.

When monomers are to be employed as a binding material, first a liquid containing polymerizable monomers and a coloring material is prepared. For this purpose, various mixing methods and devices known in the art can be employed. That is, various mixers, ball mills and attritors can be used.

Then, this liquid is micropulverized according to the same method as described above.

As the next step, the microparticulate liquid droplets formed are dispersed in a diepersing medium, followed by polymerization of the monomers in the particles formed according to the procedure such as heating. Then, the particles formed are separated by the method such as decantation or filtration, dried and washed to recover toner microparticles.

In order to accomplish the present invention as mentioned above, about three steps are necessary. That is, there are involved the step of obtaining a mixed liquid dispersion of a coloring material and a binding material, then the step of micropulverizing said liquid dispersion by use of an electrostatic force and further the step of recovering the liquid microparticles as solid particles.

In the step of preparing a mixed liquid dispersion, techniques known in the art may be applicable. As the device for heating mixing, there are roll mills, extruders, kneaders, kneader-ruders, Banbury mixers, ribbon blenders and the like. When a solvent is employed, microdispersing may be possible by means of three roll mills, ball mills, attritors, sand grinders and the like.

FIG. 1 shows schematically an example of the step to micropulverize a liquid product by applying an electrostatic force. 1 is a means for atomization by supplying a liquid product therethrough such as a mono-liquid-fluid nozzle, a gas-liquid bi-fluid nozzle or a rotary disc atomizer. 2 is a power source for applying an electrostatic force, which applies an electrostatic force between the atomizing means 1 and the confronting wall 3. The liquid droplet 4 supplied from the atomizing means 1 is momentarily micropulverized into spherical particles through the action of the electrostatic force to lower its surface tension and recovered from the recovery outlet 5. When a liquid supplying tank for collection 6 is provided, the spherical particles are collected in the liquid supplied from the liquid supplying tank for collection 6 to the innerside of the confronting wall 3 and recovered from the recovery outlet 5. The tank 6 may also be used as a tank for supplying a dispersing medium.

In case of a mono-fluid nozzle, a liquid dispersion is used under pressurization to about 2 to 10 kg/cm$^2$, while in case of a bi-fluid nozzle, an air pressurized to about 1.5 to 10 kg/cm$^2$ is used together with a liquid which may also be pressurized, if desired. The rotary disc comprises a rotating body called as disc or cup having a diameter of about 70 mm to 120 cm and rotated at 400 to 80,000 rpm by a driving force such as an electric motor or an air turbine. The disc may be provided with grooves or made into a shape like saw-tooth at the edge portion depending on the purposes. A rotary disc is very effective for micropulverization and for making uniform the sizes of particles.

An electrostatic force can be permitted to act by applying a direct current of 2 KV to 200 KV, preferably 60 KV to 120 KV, to the counter-electrodes.

The liquid product may be supplied at a rate generally from 5 ml/min. to 1000 ml/min.

Solid particles can be obtained by collection of the liquid microparticles generally by use of a cyclone, a bag filter, etc. while creating an air stream, into which a hot or cold air may be optionally flown. The liquid microparticles obtained by such a method are very minute and therefore immediately solidified even in case of a molten product. Accordingly, when a material with a rapid solidifying speed is employed, there may be sometimes employed the method in which the microparticles are passed through the zone with a temperature gradient by supplying a hot air for the purpose of taking a time for spherical formation in order to obtain spherical particles. Drying is also sufficiently effected only by passing through a hot air, because drying of minute particles can be accomplished within a very short time.

For the purpose of collecting atomized liquid microparticles in a liquid, a liquid film is formed in the vicinity of the region where microparticles are to be formed. Since the microparticles formed by such a method are very minute and liable to be scattered, it is also useful to create an air stream optionally with supply of a hot air or a cold air, for more efficient collection thereof.

Various liquids which will not dissolve microparticles formed at normal temperature may be available for collection of such microparticles. Generally speaking, a liquid having a not too high boiling point is desirable to make the subsequently required drying step easier. On the other hand, for easiness in handling, a liquid with an extremely low boiling point is not appropriate. A desirable boiling point may be in the range from 50° C. to 140° C., and water, various alcohols, isoparaffin type solvents may be mentioned as suitable ones. The liquid may also be previously mixed with surfactants, stabilizers, dispersants, agglomeration preventives, etc., if desired.

In the embodiment wherein microparticles are collected in a liquid, there is employed a liquid miscible with the solvent to be used first in making a liquid product of toner materials.

The particles collected in a liquid as described above are then filtered and dried. If necessary, prior to the filtration separation, there may also be provided the steps such as classification, surface treatment, etc.

By way of the step of collecting particles in a liquid, agglomeration or integration of particles can be better prevented, whereby there can be obtained a powdery product which is good in fluidity and excellent in stability.

As the binding material to be employed for accomplishing the present invention, there may be included, for example, those known as waxes such as carnauba wax, paraffin wax, Sazole wax, microcrystalline wax, castor wax, etc.; higher fatty acids and derivatives thereof such as metal salts, esters, etc., namely stearic acid, palmitic acid, lauric acid, aluminum stearate, lead stearate, barium stearate, zinc stearate, zinc palmitate, methylhydroxy stearate, glycerol monohydroxy stearate, and the like. Polyolefins and copolymers of olefine are also useful, as exemplified by polyethylene, polyethylene wax, polypropylene, polyethylene oxide, polyisobutylene, polytetrafluoroethylene, ethylene-acrylic acid copolymer, ethylene-ethyl acrylate copolymer, ethylenevinyl acetate copolymer, etc.

The above materials have crystalline characteristics and are rapid in solidifying speed. Therefore, they can be readily formed into spheres on micropulverization from a molten state and very easily handled. Also, when other thermoplastic materials are added as additive components to the above materials, they can be micropulverized under molten state.

As the binding material suitable for use to be dissolved in a solvent, there may be employed polymers of styrene or substituted derivatives thereof such as polystyrene, poly-p-chlorostyrene, polyvinyltoluene, etc.; copolymers such as styrene-vinyl toluene copolymer, styrene-ethyl acrylate copolymer, styrene-butyl methacrylate copolymer, etc.; acrylic polymers such as polymers of methyl methacrylate, 2-ethylhexyl methacrylate, n-butyl methacrylate, etc.; copolymers such as methyl methacrylate-methyl acrylate copolymer, etc.; ethylenic polymers such as polyvinyl chloride, polyvinyl acetate, etc.; polyurethanes; polyamides, epoxy resins; polyester resins; terpene type resins; aliphatic or alicyclic hydrocarbon resins, petroleum resins; and others.

The above materials can be used by dissolving in a solvent such as toluene, xylene and others. Solvents may be employed in amounts of 20 to 95% by weight based on the resin solution. If desired, they may be used under heating.

When a polymerizable monomer is to be employed as a toner material, representative monomers may include styrene type monomers such as styrene, p-chlorostyrene, vinyl naphthalene, etc.; vinyl acetate, vinyl propionate, vinyl benzonate, vinyl butyrate and the like; esters of α-methylene aliphatic monocarboxylic acids (e.g. methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate and the like); N-vinyl compounds, N-vinylpyrrole, N-vinylcarbazole, N-vinylindole; and so on. These monomers may be used either singly or as a mixture.

As the coloring material to be used in the present invention, there may be included known dyes or pigments such as carbon black, iron black, phthalocyanine blue, ultramarine, quinacridone, benzidine yellow, etc.

Particularly, the conditions for coloring materials to be used in combination with a monomer are dispersibility in monomers and insolubility in a dispersing medium in the subsequent collecting polymerization steps, and further sufficient coloration ability when employed as a toner. As such materials, there are phthalocyanine type pigments such as copper phthalocyanine, anthraquinone type pigments, carbon black, varioud dyes, magnetic pigments such as magnetite, etc. The above pigments may also be subjected to surface treatments or working, etc. in order to increase dispersibility or stability.

Further, when the toner of the present invention is made a magnetic toner, there are incorporated magnetic powders which may also function as a coloring material. As magnetic powders, it is possible to employ ferromagnetic elements and alloys or compounds containing these elements, for example, alloys or compounds of iron, cobalt, nickel, manganese, etc. such as magnetite, hematite, ferrite, etc. and other ferromagnetic alloys known in the art.

Also, for the purpose of imparting charges, controlling of charging or prevention of agglomeration, there may also be added nigrosine, metal complexes, fine colloidal silica powders, fluorine type resin powders and others.

When polymerizable monomers are to be used as the toner material, there may be employed any desired initiator which is compatible with individual monomers to be used. For example, there may be employed peroxide type initiators and azo type initiators, especially preferably in the present invention azobis(2-methylpropionitrile) and lauroyl peroxide. Initiators may be added either at the time of mixing of a pigment and a monomer or after mixing of a coloring material and a monomer. Initiators may be added in amounts suitably in the range from about 2 to 10 wt. % based on the monomer, particularly preferably from 2 to 5 wt. %.

And, as a dispersing medium to be used in recovery of microparticulates containing a monomer, there may be employed various solvents, either singly or as a mixture. Most generally, water is employed optionally admixed with a stabilizer or a dispersant such as polyvinyl alcohol, ethylene glycol, glycerine, etc.

The toner obtained in the present invention is shaped completely uniformly, namely in the shape of a true sphere, and its particle size is surprisingly uniform as compared with those of the prior art. For this reason, it is excellent in fluidity, easy in handling as well as good in stability. Further, it is free from contamination of the developing device or occurrence of unnecessary adhesion on the surface of a photosensitive body, whereby good images can be obtained.

In preparation of microcapsule particles, the first step of stomizing components for a core material while applying a voltage and the second step of forming shells by dispersing the aforesaid atomized core material in a liquid containing shell material are carried out substantially continuously.

In the specific embodiments of the present invention, a plus or minus high voltage is applied to core materials under the situation where the amount of an emulsifier during core formation is very small or absent at all, while at the same time applying a mechanical function such as a high speed rotation or pressurization, thereby permitting the core materials to fly through the electric field, uniformly micropulverized liquid droplets are migrated into wall materials or a dispersing medium containing wall materials which have been applied with earthing. As a consequence, there are obtained microcapsule particles in which there exists substantially or entirely no emulsifier.

As the core material to be used in preparation of a microcapsule toner, there may be employed all materials which can be discharged by means of a nozzle or a bell into a medium containing a shell material while applying a voltage. Generally speaking, materials which exhibit liquid or suspended dispersion states during discharging are effective. Examples of such materials are polyester resins; polyester based urethane polymers; polyester based alkyd resins; various modified polyester resins, as exemplified typically by trimellitic acid ester of polycaprolactone, rosin ester, modified rosin ester, the reaction product of isopropylidene diphenoxypropanol and adipic acid, the reaction product of isopropylidene diphenoxypropanol and sebacic acid, etc.; waxes as exemplified typically by polyethylene wax, carnauba wax, castor wax, rice wax, shellac wax, Sazol wax, amide wax, montan wax, microcrystalline wax, ceresine wax, paraffin wax, ozocerite, etc.; behenic acid amide, stearic acid amide, palmitic acid amide, lauric acid amide, erucic acid amide, brassidic acid amide, oleic acid amide, eraidic acid amide, methylenebisbehenic acid amide, methylenebisstearic acid amide, methylenebisoleic acid amide, hexamethylenebisstearic acid amide, hexamethylenebisoleic acid amide, octamethylenebiserucic acid amide, monoalkylol amide, polyamide prepared from dimerized linoleic acid and a diamine or a polyamine, polyamide resins, typically a reaction product between a dicarboxylic acid and a straight chain diamine; polyvinyl acetates; ethylene-vinyl acetate copolymers; polyisobutylene; polystyrene; dodecyl acrylate-styrene copolymers; polyurethane elastomers; epoxy resins; epoxidized phenol-formaldehyde resins; acrylic resins; and so on. The above resins may be used either singly or sometimes as a mixture. These core materials which are to be atomized under molten state or dispersed state are required to have a sufficiently low melt viscosity, and have a softening temperature generally of about 5° to 200° C., particularly preferably about 30° to 150° C.

Further, if necessary, in the above binding resin, there may also be added additives such as magnetic powders, coloring pigments, dyes, water miscible solvents, charge controllers, hardning agents, fluidity controllers and stabilizers. As coloring agents, all of the known dyes and pigments can be used, such as carbon black, iron black, nigrosine, benzidine yellow, quinacridone, rhodamine B, phthalocyanine blue and others. The amount of a pigment added may suitably be controlled depending on the pigment employed as well as the degree of coloration. When used as a toner, for improvement of heat melt flow characteristics of a core material, it is added in an amount of 80% by weight or less based on the resin, preferably 70% of less, particularly preferably 30 to 60% by weight.

As magnetic powders, there may be employed all substances which can be magnetized when placed in a magnetic field, including generally powders of a ferromagnetic metal such as iron, cobalt or nickel, compounds such as magnetite, hematite, ferrite, etc. The content of the magnetic powders may be 10 to 80% by weight based on the weight of the core material, preferably 30 to 60% by weight. As other additives to be used in the present invention, there may be included charge controllers as exemplified typically by various metal complexes, nigrosine, iron black, graphite, etc.; lubricants, typically polytetrafluoroethylene; and plasticizers, typically dicyclohexyl phthalate. When these additives are used, if they are added in too much amounts, the viscosity increases too high, whereby micropulverization is rendered difficult and delivery pressure is disadvantageously increased too high. The above core materials may be used with addition of a solvent or under heating, if desired.

Other core materials which can be used in the present invention may include oils exemplified typically by corn oil, castor oil, mineral oil, cod-liver oil; perfumes; rust preventives; liquid crystal materials; vitamins; minerals and nutrients; pharmaceuticals; lubricants, typically polytetrafluoroethylene; plasticizers, typically dicyclohexyl phthalate; and so on. The additive employed may be used in an amount which may differ greatly depending on the purpose of use, but generally 20 to 200% by weight, preferably 25 to 100% by weight. When these additives are used in too much amounts, the viscosity is increased too high, whereby micropulverization is rendered difficult and delivery pressure is disadvantageously increased too high. The above materials may be used with addition of a solvent or under heating, if desired.

As the shell materials to be used in the present invention, there may be employed all of the materials which exhibit a liquid state under normal temperature and soluble or dispersible in water and organic and inorganic solvents. Further, a part of the shell material may be added to the core material.

As shell materials, there may be included, for example, polystyrene, polymonochlorostyrene, methacrylic acid resin, methacrylate resin, polyacrylic acid, acrylate resin, polyethylene oligomers, polyester oligomers, polyamide oligomers, polyurethane oligomers, polybutadiene, polyvinyl acetate, poly(5-ethyl-2-vinylpyridine), diethylaminoethyl methacrylic acid resin, diethylaminoethyl acrylic acid resin, poly(2-methyl-5-vinylpyridine), poly(vinylpyrrolidone), etc. The above compounds may be supplied onto the surface of a confronting wall toward which the core material particles come by flying, singly as such or as a copolymer or sometimes as a mixture under a solubilized or dispersed in water and an organic or inorganic solvent.

As the solvent for the shell material to be used in the present invention, there may be included amides such as dimethylformamide, dimethylacetamide, N-methylpyrrolidone, etc.; ketones such as methyl ethyl ketone, methyl isobutyl ketone, methyl propyl ketone, diethyl ketone, cyclohexanone, etc.; esters such as dioxane, tetrahydrofuran, ethyl ether, ethylene glycol diethylether, etc.; esters such as methyl formate, ethyl formate, methyl acetate, ethyl acetate, ethyleneglycol monoethyl ether acetate, glycol diacetate, etc.; alcohols such as n-butyl alcohol, sec-butyl alcohol, isobutyl alcohol, cyclohexanol, benzyl alcohol, etc.; chloro-substituted hydrocarbons such as methylene chloride, $\beta,\beta'$-dichlorodiethylether; and nitro compounds such as nitromethane, nitroethane, etc. The resin of the shell material may be added to these solvent in an amount of 1 to 100% by weight, preferably 5 to 50% by weight.

It is also possible in some cases to add into a solution of a shell material a crosslinking agent, a polymerization initiator, a colorant, a charge controller, a hardening agent, a flow controller, a stabilizer, etc.

The shell material to be used in the present invention may be added in an amount which can be selected widely so as to exhibit good electrophotographic characteristics. Generally, a shell material mav be added so that the film thickness of the shell material may be 1/1000 to 10 times, preferably 1/500 to 1/50 times the particle diameter of a core material. With such a proportion, there can be obtained good toners endowed with both good developing characteristics and good fixing characteristics.

As a discharging machine for producing core particles in the present invention, there may be mentioned a bi-fluid nozzle, a pressurizing nozzle and a rotary disc type bell equipped with a high voltage generating device. Preferably, there may be employed a bi-fluid nozzle having adjacent openings with jetting directions for micropulverization of molten core materials which are in parallel or transverse to each other or a rotary disc type bell with its atomizing head being minutely worked to have a number of grooves. The core material to be discharged is previously kneaded sufficiently by a conventionally utilized homomixer, disperser, roll mill, sand mill, ball mill, centrimill, Susmiermill, etc.

Figure 2:
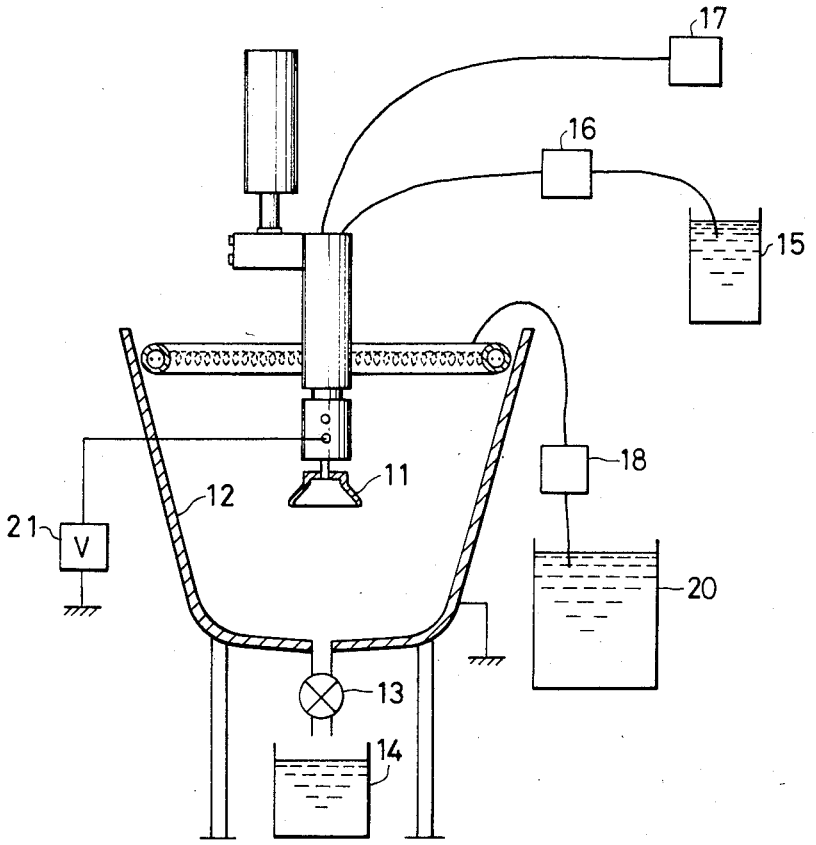
FIG. 2 is a schematic illustration of one example of a rotary disc type bell discharging machine.

FIG. 2 shows schematically an example of a rotary disc type bell discharging machine. In FIG. 2, 11 is a rotary bell and 15 is a tank for containing a liquid product of a core material. This core material is delivered by a pump 16 and supplied to the rotary bell 11 which is rotated by an air turbine motor 17. The core material atomized by the rotary bell 11 is permitted to fly toward the confronting wall 12. To the inner wall of the confronting wall 12 is supplied a liquid containing a shell material by a pump 18 from the tank 20, and the aforesaid core particles are dispersed in said liquid and collected through a discharging valve 13 in a collecting tank 14. 21 is a power source which applies a high voltage between the bell 11 and the confronting wall 12.

The pressure for delivering a core material to an atomizing head comprising a nozzle or a bell may be freely controlled so as to obtain desired particle sizes. When utilizing a bi-fluid nozzle, a core material is delivered under a delivery pressure which may be generally 1 to 100 kg/cm$^2$, preferably 2 to 10 kg/cm$^2$ and under a hot air pressure of 5 to 50 kg/cm$^2$. On the other hand, when utilizing a rotary disc type bell, the rotational speed of the bell, which may vary depending on the core material employed, is generally 1000 to 100,000 rpm, preferably 5000 to 50,000 rpm. When utilizing a rotary disc type bell, the core material is supplied at a delivery rate which may be generally 1 to 200 g/min., preferably 20 to 100 g/min. As the pump to be used for delivery, there may preferably be used centrifugal system, reciprocal system or rotatory system pumps which can maintain constantly continuous streams with little pulsatory motions, as exemplified by volute pump, turbo pump, propeller pump, gear pump, screw pump, partition plate pump, magnet pump, labopump, diaphragm pump, bellows pump, banton pump, etc.

In the present invention, a high voltage applied on a nozzle or a bell may be a direct current voltage which is generally 2 to 200 KV, preferably 40 to 90 KV. The above voltage applied may vary depending on the material employed, but no sufficient micropulverization may be possible at an applied voltage lower than the above range, while the micropulverization effect is saturated at an applied voltage higher than the above range, whereby no effect can be exhibited by the increase of the voltage.

In the present invention, as the method for microencapsulation, there is employed the method wherein a core material previously micropulverized by an atomizing head is permitted to flow into a medium containing a shell material which flows over a confronting wall applied electrically with earthing. The confronting wall applied with earthing and the atomizing head applied with the voltage must be kept apart at a distance so that no dielectric breakdown may usually occur.

In the present invention, the distance between the atomizing head portion on which a voltage is to be applied and the surface of the confronting wall, which may vary depending on the voltage applied, is usually 50 to 500 mm, preferably 100 to 200 mm, in case of an applied voltage of 80 KV.

In the present invention, the microcapsule toner suspension can be cooled or filtered as such to give microencapsulated toners.

As the method to polymerize further the shell material of the microcapsule toner obtained in the present invention, the suspension may be once transferred into a reactor, where thermal polymerization is conducted, or it can be transferred continuously through a tubular system provided with a heating jacket. Usually, polymerization may be carried at 50° to 150° C., more preferably at 60° to 100° C., for 5 to 10 hours.

The microcapsule toner produced in the present invention has a particle diameter of about 10 μm effective for electrophotographic characteristics as the result of lowering of surface tension of the material caused by the action of a high voltage applied to the atomized core material discharged from a nozzle or a disc end, and the core material particles produced have a very narrow particle size distribution. As the result, the microencapsulated toner particles produced by attachment of a shell material to the core material can be also obtained as microcapsule toners with uniform particle sizes.

The toner produced according to the method of the present invention can be applied for development according to various methods. For example, there may be employed the magnetic brush developing method as disclosed in U.S. Pat. No. 2,874,063; the cascade developing method as disclosed in U.S. Pat. No. 2,618,552; the powder cloud method, the fur brush developing method as disclosed in U.S. Pat. No. 2,221,776; further the method employing a conductive magnetic toner as disclosed in U.S. Pat. No. 3,909,258; the method employing a high resistance magnetic toner as disclosed in Japanese Laid-open Patent Publication No. 31136/1978; and the methods disclosed in Japanese Laid-open Patent Publication Nos. 42141/1979, 42142/1979 and 43027/1979.

For fixation of the toner, there may be employed the heat chamber method or heat roll method utilizing a heat energy and the fixation method by pressurization as disclosed in U.S. Pat. No. 3,269,626.

The present invention is now described in more detail by referring to specific embodiments.

EXAMPLE 1

The following materials were mixed.

| | |
|---|---|
| Low molecular weight polyethylene | 100 wt. parts |
| Carbon black | 5 wt. parts |

The above mixture was placed in a vessel heated at 150° C. and stirred homogeneously by means of a mixer to obtain a fine dispersion of carbon black. This liquid product was supplied through a gear pump and a heat pipe into a disc atomizer having a rotating body of 12 cm in diameter and micropulverization was effected by rotating the atomizer at 15,000 rpm while applying a static voltage of −90 KV on the counter-electrodes.

The liquid was supplied at a rate of 100 ml/min., the micropulverizing device was placed in a sealed cylinder and the powders were collected by a cyclone while permitting an air heated at 90° C. to flow into the cylinder. The powders were found to be very good in fluidity. Each particle was a completely true sphere and the volume average diameter as measured by Coulter counter was 11.3 μm, with 93% of the total weight occurring between 6.3 μm and 12.3 μm. Thus, it was confirmed that the powders obtained had very uniform particle sizes. A developer was prepared by adding 80 parts by weight of iron powders to 10 parts of said toner. After development of the surface of a support carrying a photoconductive material having a positive electrostatic latent image, the developed image was transferred onto a plain paper and fixed by means of a fixing device by applying a pressure of 15 kg/cm, whereby there was obtained a very clear image which was also completely fixed.

EXAMPLE 2

The following materials were mixed.

| | |
|---|---|
| Polystyrene resin (weight average molecular weight: 35,000) | 100 wt. parts |
| Magnetite | 60 wt. parts |
| Toluene | 200 wt. parts |

The above mixture was placed in a mixer device having a high shearing force, and homogeneously stirred to obtain a dispersion of resin and pigment.

This liquid product was supplied through a gear pump and a heat pipe into a disc atomizer having a rotating body of 20 cm in diameter and micropulverization was effected by rotating the atomizer at 10,000 rpm while applying a static voltage of −100 KV. The liquid was supplied at a rate of 80 ml/min., the micropulverizing device was placed in a sealed cylinder and the powders were collected by a cyclone while permitting an air heated at 170° C. to flow into the cylinder. The powders were found to be very good in fluidity. Each particle was a completely true sphere and completely dry. The volume average diameter as measured by Coulter counter was 9.4 μm, with 90% of the total weight occurring between 8μ and 11μ. Thus, it was confirmed that the powders obtained had very uniform particle sizes.

A developer was prepared by mixing 100 parts by weight of said toner with 0.3 part of a hydrophobic colloidal silica and then a photoconductive member having a positive electrostatic latent image was developed, followed by passing through a heat chamber fixing device. The image obtained was found to be clear and completely fixed.

EXAMPLE 3

The following materials were mixed.

| | |
|---|---|
| Epoxy resin | 100 wt. parts |
| Carbon black | 5 wt. parts |
| Xylene | 500 wt. parts |

The above mixture was placed in a vessel heated at 150° C. and stirred homogenously by means of a mixer to obtain a fine dispersion of carbon black. This liquid product was passed through a gear pump and a heat pipe and micropulverized by means of a bi-fluid nozzle with nozzle diameter of 2.5 mm with the use of an air pressurized at 6 kg/cm$^2$. During this operation, a voltage of −90 KV was applied. The liquid was supplied at a rate of 80 ml/min., the micropulverizing device was placed in a sealed cylinder and the fine particles formed were collected in a vessel filled with an isoparaffin type solvent, filtered and dried to obtain powders. The powders were found to be very good in fluidity. Each particle was a completely true sphere. The volume average diameter as measured by Coulter counter was 15.3μ, with 80% of the total weight occuring between 5.0μ and 20.0μ. Thus, it was confirmed that the powders obtained had a very uniform particle size distribution.

To 5 parts by weight of the toner prepared were added 80 parts by weight of iron powder carriers to prepare a developer, and the latent image on a photoconductive material was developed with this developer. Transfer of the developed image onto a plain paper, followed by fixing by passing through a heat chamber type fixing machine, gave a very clear and completely fixed image.

EXAMPLE 4

The following materials were mixed.

| | |
|---|---|
| Low molecular weight polyethylene | 100 wt. parts |
| Carbon black | 5 wt. parts |

The above mixture was placed in a vessel heated at 150° C. and stirred homogeneously by means of a mixer to obtain a fine dispersion of carbon black. This liquid product was supplied through a gear pump and a heat pipe into a disc atomizer having a rotating body of 12 cm in diameter and micropulverization was effected by rotating the atomizer at 15,000 rpm while applying a static voltage of −90 KV on the counter-electrodes. The liquid was supplied at a rate of 100 ml/min., the micropulverizing device was placed in a sealed cylinder and the powders were collected in a water stream provided at the outer wall of a cyclone type vessel while permitting an air heated at 90° C. to flow into the cylinder, followed by filtration and drying. The powders were found to be very good in fluidity. Each particle was a completely true sphere and the volume average diameter as measured by Coulter counter was 11.3 μm, with 93% of the total weight occurring between 6.3μ and 12.3μ. Thus, it was confirmed that the powders obtained had very uniform particle sizes.

A developer was prepared by adding 80 parts by weight of iron powders to 10 parts of said toner. After development of the surface of a support carrying a photoconductive material having a positive electrostatic latent image, the developed image was transferred onto a plain paper and fixed by means of a fixing device by applying a pressure of 15 kg/cm, whereby there was obtained a very clear image which was also completely fixed.

EXAMPLE 5

The following materials were mixed.

| | |
|---|---|
| Polystyrene resin (average molecular weight 35,000) | 100 wt. parts |
| Magnetite | 60 wt. parts |
| Toluene | 200 wt. parts |

The above mixture was placed in a mixer device having a high shearing force, and homogeneously stirred to obtain a dispersion of resin and pigment.

This liquid product was supplied through a gear pump and a heat pipe and micropulverized by rotating a disc atomizer having a rotating body of 20 cm in diameter at 10,000 rpm. During this operation, a static voltage of −90 KV was applied. The liquid was supplied at a rate of 80 ml/min., the micropulverizing device was placed in a sealed cylinder and the powders were collected by a cyclone provided with a water stream while permitting an air heated at 170° C. to flow into the cylinder. The powders were found to be substances of very high fluidity. Each particle was a completely true sphere and completely dry. The volume average diameter as measured by Coulter counter was 9.4 μm, with 90% of the total weight occurring between 8μ and 11μ. Thus, it was confirmed that the powders obtained had very uniform particle sizes.

A developer was prepared by mixing 100 parts by weight of said toner with 0.3 part of a hydrophobic colloidal silica and then a photoconductive member having a positive electrostatic latent image was developed, followed by passing through a heat chamber fixing device. The image obtained was found to be clear and completely fixed.

EXAMPLE 6

To 100 g of styrene monomer was added 5 g of lauroyl peroxide, followed by mixing to be dissolved therein. After adding 7 g of carbon black to this solution, the mixture was further subjected to mixing. Then, this mixture was supplied to an atomizer having a rotating disc of 12 cm in diameter and micropulverized by rotating the disc at 50,000 rpm simultaneously with application of a static voltage of +90 KV. Counterelectrodes were provided adjacent to the disc, and a fluid flow surface of a 1.25% aqueous polyvinyl alcohol solution was formed thereat, where liquid droplets were collected. Then, the dispersion collected was placed in a reaction vessel constituted of a 100 ml round-bottomed flask with a stirrer and polymerization was carried out by heating the mixture at about 70° C. while continuing stirring at 60 to 80 rpm for 6 hours. Particles were separated from the dispersion containing particles, washed and dried. The resultant powders were very good in fluidity, individual particles being completely spherical and having a volume average particle diameter of 10.3μ, with 90 wt. % being confirmed to occur between 8μ and 12μ.

A developer was prepared by adding 80 parts by weight of iron powder carriers to 5 parts of the toner prepared. After development of the surface of a support carrying a photoconductive material having a positive electrostatic latent image, the developed image was transferred onto a plain paper and passed through a heat chamber type fixing machine, whereby there was obtained a very clear image which was also completely fixed.

EXAMPLE 7

Example 6 was repeated except that a mixture of 65 parts of styrene and 35 parts of n-butyl methacrylate as monomers was used as the monomer, 2 parts of azobisisobutyronitrile as the initiator and ethyl cellulose as the stabilizer. As the result, good results were obtained similarly as in Example 6.

EXAMPLE 8

| | |
|---|---|
| Polyethylene resin | 100 parts |
| Ethylene-vinyl acetate copolymer | 20 parts |
| Magnetite | 80 parts |

A molten product prepared by the kneading treatment of the above mixture by means of a homomixer at 120° C. for 2 hours was supplied to the bell portion by means of a metering gear pump equipped with a heating pot and a heating tube at a discharging rate of 50 g/min. As the bell, there was employed G-bell (produced by Landsburg Co.) of which grooves were minutely worked, and atomization was effected at 30,000 rpm with an applied voltage of −80 KV.

On the other hand, a solution of a mixture comprising:

| | |
|---|---|
| Styrene-ethyl acrylate copolymer | 20 parts |
| Diethylaminoethyl methacrylate resin | 3 parts |

dissolved in DMF was supplied at a rate of 3 liter/min. onto the surface to be coated. The resultant microcapsule toners was collected, filtered and dried to obtain microencapsulated toners. When the particle size distribution was measured by Coulter counter, it was found that the volume average particle size was 10.9 μm and the toners having particle sizes between 6.35μ and 20.2 μm comprise 92 wt. % of the total particles. Further, when provided as a developer with addition of 0.3% by weight of a hydrophobic colloidal silica for development by the improved NP-120 copying machine (produced by Canon K.K.), there was obtained a clear copy with good fixing characteristic.

EXAMPLE 9

| | |
|---|---|
| Polyethylene resin | 100 parts |
| Ethylene-vinyl acetate copolymer | 20 parts |
| Magnetite | 80 parts |

A molten product prepared by the kneading treatment of the above mixture by means of a homomixer at 120° C. for 2 hours was supplied to the bell portion by means of a metering gear pump equipped with a heating pot and a heating tube at a discharging rate of 50 g/min. As the bell, there was employed G-bell (produced by Landsburg Co.) of which grooves were minutely worked, and atomization was effected at 30,000 rpm with an applied voltage of −80 KV.

On the other hand, a solution of a mixture comprising:

| | |
|---|---|
| Styrene-ethyl acrylate copolymer | 20 parts |
| Methyl methacrylate resin | 3 parts |

dissolved in DMF was supplied at a rate of 3 liter/min. onto the surface to be coated. The resultant microcapsule toner was collected, filtered and dried to obtain a microencapsulated toner. When the particle size distribution was measured by Coulter counter, it was found that the volume average particle size was 10.2 μm and the toners having particle sizes between 6.35μ and 20.2 μm comprise 89 wt. % of the total particles. Further, when provided as a developer with addition of 0.3% by weight of a hydrophobic colloidal silica for development by the improved NP-120 copying machine (produced by Canon K.K.), there was obtained a clear copy with good fixing characteristic.

EXAMPLE 10

| | |
|---|---|
| Polyethylene resin | 100 parts |
| Ethylene-vinyl acetate copolymer | 20 parts |
| Magnetite | 80 parts |

A molten product prepared by the keading treatment of the above mixture by means of a homomixer at 120° C. for 2 hours was supplied to the bell portion by means of a metering gear pump equipped with a heating pot and a heating tube at a discharging rate of 50 g/min. As the bell, there was employed G-bell (produced by Landsburg Co.) of which grooves were minutely worked, and atomization was effected at 30,000 rpm with an applied voltage of −80 KV.

On the other hand, a solution of a mixture comprising:

| | |
|---|---|
| Styrene-ethyl acrylate copolymer | 20 parts |
| Methyl methacrylate resin | 3 parts |
| Diethylaminoethyl methacrylate resin | 1 part |

dissolved in DMF was supplied at a rate of 3 liter/min. onto the surface to be coated. The resultant microcapsule toner was collected, filtered and dried to obtain a microencapsulated toner. When the particle size distribution was measured by Coulter counter, it was found that the volume average particle size was 10.8 μm and the toners having particle sizes between 6.35μ and 20.2 μm comprise 88 wt. % of the total particles. Further, when provided as a developer with addition of 0.3% by weight of hydrophobic colloidal silica for development by the improved NP-120 copying machine (produced by Canon K.K.), there was obtained a clear copy with good fixing characteristic.

EXAMPLE 11

When the same microcapsule toners as in Example 8 were prepared and collected, heating polymerization was further conducted in the reactor at 80° C. for 5 hours. When the particle size distribution was measured by Coulter counter, it was found that the volume average particle size was 9.9 μm and the toners having particle sizes between 6.35μ and 20.2 μm comprise 90 wt. % of the total particles. Further, when provided as a developer with addition of 0.3% by weight of a hydrophobic colloidal silica for development by the improved NP-120 copying machine (produced by Canon K.K.), there was obtained a clear copy with good fixing characteristic.

EXAMPLE 12

When the same microcapsule toners as in Example 9 were prepared and collected, heating polymerization was further conducted in the reactor at 80° C. for 5 hours. When the particle size distribution was measured by Coulter counter, it was found that the volume average particle size was 9.7 μm the toners having particle sizes between 6.35μ and 20.2 μm comprise 92 wt. % of the total particles. Further, when provided as a developer with addition of 0.3% by weight of a hydrophobic colloidal silica for development by the improved NP-120 copying machine (produced by Canon K.K.), there was obtained a clear copy with good fixing characteristic.

EXAMPLE 13

When the same microcapsule toners as in Example 10 were prepared and collected, heating polymerization was further conducted in the reactor at 80° C. for 5 hours. When the particle size distribution was measured by Coulter counter, it was found that the volume average particle size was 9 μm and the toners having particle sizes between 6.35μ and 20.2 μm comprise 92 wt. % of the total particles. Further, when provided as a developer with addition of 0.3% by weight of a hydrophobic colloidal silica for development by the improved NP-120 copying machine (produced by Canon K.K.), there was obtained a clear copy with good fixing characteristic.

EXAMPLE 14

| | |
|---|---|
| Polyethylene resin | 100 parts |
| Ethylene-vinyl acetate copolymer | 20 parts |
| Tin oxide | 80 parts |

A molten product prepared by the kneading treatment of the above mixture by means of a homomixer at 120° C. for 2 hours was supplied to the bell portion by means of a metering gear pump equipped with a heating pot and a heating tube at a discharging rate of 50 g/min. As the bell, there was employed G-bell (produced by Landsburg Co.) of which grooves were minutely worked, and atomization was effected at 30,000 rpm with an applied voltage of −80 KV.

On the other hand, a solution of a mixture comprising:

| | |
|---|---|
| Styrene-ethyl acrylate copolymer | 20 parts |
| Methyl methacrylate resin | 3 parts |
| Diethylaminoethyl methacrylate resin | 1 part |

dissolved in DMF was supplied at a rate of 3 liter/min. onto the surface to be coated. The resultant microcapsule toner was collected, filtered and dried to obtain a microencapsulated toner. When the particle size distribution was measured by Coulter counter, it was found that the volume average particle size was 10.9 μm and the toners having particle sizes between 6.35μ and 20.2 μm comprise 85 wt. % of the total particles.

We claim:

1. A method of producing a dry spherical toner, which comprises micropulverizing a toner material containing a coloring material and a binding material through an atomizing means under molten or dissolved state while applying an electrostatic force of 2 KV–200 KV between the atomizing means and a confronting wall opposed to the atomizing means for recovering micropulverized particles.

2. A method according to claim 1, wherein micropulverization is conducted by means of a fluid nozzle.

3. A method according to claim 1, wherein micropulverization is conducted by means of a rotary disc type atomizer.

4. A method of preparing a dry spherical microcapsule toner which comprises atomizing a component for a core material through an atomizing means while applying an electrostatic force of 2 KV–200 KV between the atomizing means and a confronting wall opposed to the atomizing means for recovering micropulverized particles, dispersing the said atomized core material and a liquid containing a shell material to coat the core material with the shell material, and drying.

5. A method according to claim 4, wherein atomizing is conducted by means of a fluid nozzle.

6. A method according to claim 4, where atomizing is conducted by means of a rotary disc type atomizer.

* * * * *